US006076001A

United States Patent [19]

Das

[11] Patent Number: 6,076,001

[45] Date of Patent: Jun. 13, 2000

[54] HIGH SUPERCONDUCTING FERROELECTRIC CPW VARIABLE TIME DELAY DEVICES

[76] Inventor: Satyendranath Das, P.O. Box 574, Mt View, Calif. 94042-0574

[21] Appl. No.: 08/869,929

[22] Filed: Jun. 5, 1997

[51] Int. Cl.[7] ..... H01P 1/18; H01B 12/02

[52] U.S. Cl. ..... 505/210; 505/700; 505/701; 505/866; 333/995; 333/161

[58] Field of Search ..... 333/995, 161; 505/210, 700, 701, 866

[56] References Cited

U.S. PATENT DOCUMENTS

| | | | |
|---|---|---|---|
| 5,164,692 | 11/1992 | Gertel et al. | 333/238 |
| 5,472,935 | 12/1995 | Yandrofski et al. | 505/700 X |
| 5,777,532 | 7/1998 | Lakin | 333/161 |

*Primary Examiner*—Benny T. Lee

[57] ABSTRACT

A symmetrical coplanar waveguide is formed by a spiral with three arms. One arm is 1, the second arm is 2 and the 3rd arm is 41. The arms 1 and 2, and spiral arms 1 and 41 are separated by equal distance. The spiral arms 1, 2 and 41 are formed by the deposition of films of a conductor, layer 3, on a film 14 of a single crystal ferroelectric material, layer 2, which is deposited on a single crystal dielectric material, layer 1. Input is 10 and the output is 11. The CPW spiral arms 1, 2 and 41 form a time delay device. When a bias voltage V is applied between the spiral arms 1 and 2, and between 1 and 41 through a bias filter made of L and C, the permittivity of the ferroelectric film between the spiral arms 1 and 2, and between 1 and 41 or across the CPW, changes producing a change in the time delay. By the application of different levels of bias voltage between the spiral arms 1 and 2, and between 1 and 41, different permittivity of the ferroelectric material are obtained and thus different changes in the time delay are obtained. Thus a variable time delay is obtained. Other delay embodiments are (1) meander line, (2) square shaped structure, (3) interdigital line, (4) parallel CPW.

18 Claims, 14 Drawing Sheets

HIGH SUPERCONDUCTING FERROELECTRIC CPW VARIABLE TIME DELAY DEVICES

FIELD OF INVENTION

The present invention relates to variable time delay devices for electromagnetic waves and more particularly, to RF variable time delay devices which can be controlled electronically. Commercial time delay devices are available.

DESCRIPTION OF THE PRIOR ART

Ferroelectric materials have a number of attractive properties. Ferroelectrics can handle high peak power. The average power handling capacity is governed by the dielectric loss of the material. They have low switching time (such as 100 nS). Some ferroelectrics have low losses. The permittivity of ferroelectrics is generally large, as such the device is small in size. The ferroelectrics are operated in the paraelectric phase, i.e. slightly above the Curie temperature to prevent hysteresis and a hysteresis loss with a.c. biasing field. Inherently, they have a broad bandwidth. They have no low frequency limitation as contrasted to ferrite devices. The high frequency operation is governed by the relaxation frequency, such as 95 GHz for strontium titanate, of the ferroelectric material. The loss of the ferroelectric high Tc superconductor RF variable time delay devices is low for ferroelectric materials, particularly single crystals, with a low loss tangent. A number of ferroelectrics are not subject to burnout. Ferroelectric variable time delay devices are reciprocal. Because of the dielectric constant of these devices varies with a bias voltage, the impedance of these devices varies with a biasing electric field.

There are three deficiencies to the current technology : (1) The insertion loss is high as discussed by Das in U.S. Pat. No. 5,451,567. (2) The properties of ferroelectrics are temperature dependent. (3) The third deficiency is the variation of the VSWR over the operating range of the time delay device. Das used a composition of polycrystalline barium titanate, of stated Curie temperature being 20 degrees C. and of polythene powder in a cavity and observed a shift in the resonant frequency of the cavity with an applied bias voltage based on the publication by S. Das, "Quality of a Ferroelectric Material," IEEE Trans. MTT-12, pp. 440–448, July 1964.

Das discussed operation, of microwave ferroelectric devices, slightly above the Curie temperature, to avoid hysterisis and showed the permittivity of a ferroelectric material to be maximum at the Curie temperature and the permittivity to reduce in magnitude as one moves away from the Curie temperature based on the publication by S. Das, "Quality of a Ferroelectric Material," IEEE Trans. MTT-12, pp. 440–445, July 1964.

Properties of ferroelectric devices have been discussed in the literature. R. Das, "Ferroelectric Phase Shifters," IEEE Int'l Symposium Digest, pp. 185–187, 1987. R. Das, "Thin Ferroelectric Phase Shifters'" Solid State Electronics, vol. 10, pp. 857–863, 1967. Ferroelectrics have been used for the time delay steering of an array. S. Das, "Ferroelectrics for time delay steering of an array," Ferroelectrics, 1973, pp. 253–257. Scanning ferroelectric apertures have been discussed. S. Das, "Scanning ferroelectric apertures," The Radio and Electronic Engineer, vol. 44, No. 5, pp. 263–268, May 1974. A high Tc superconducting ferroelectric phase shifter has been discussed. C. M. Jackson, et al, "Novel monolithic phase shifter combining ferroelectric and high temperature superconductors," Microwave and Optical Technology Letters, vol. 5, No. 14, pp. 722–726, Dec. 20, 1992. One U.S. Pat. No. 5,472,936 has been issued.

SUMMARY OF THE INVENTION

A symmetrical coplanar waveguide is formed by a spiral with three arms. Spiral arms are separated by equal distance. The spiral arms are formed by the deposition of films of a conductor, a third layer, on a film of a single crystal ferroelectric material, a second layer, which is deposited on a single crystal dielectric material, a first layer. The CPW spiral arms form a time delay device.

When a bias voltage V is applied between the spiral arms through a bias filter made of an inductor L and a capacitor C, the permittivity of the ferroelectric film between the spiral arms or across the CPW, changes producing a change in the time delay. By the application of different levels of bias voltage between the spiral arms, different permittivity of the ferroelectric material are obtained and thus different changes in the time delay are obtained. Thus a variable time delay is obtained. Other delay embodiments are (1) meander line, (2) square shaped structure, (3) interdigital line, (4) parallel CPW. One objective of this invention is to obtain a broad bandwidth variable time delay device. Another objective of this invention is to obtain a loss typically of 0.035 dB per wavelength in the ferroelectric material by the use of a single crystal ferroelectric material. Another objective of this invention is to obtain a minimum of conductive loss by the use of a single crystal high Tc superconductor. Another objective of this invention is to obtain a minimum dielectric loss by the use of a single crystal dielectric material. Examples of a single crystal ferroelectric material are $Sr_{1-x}Ba_xTiO_3$, $Sr_{1-x}Pb_xTiO_3$, $KTa_{1-x}Nb_xO_3$(KTN) where the value of x varies between 0.005 and 0.7 Examples of other ferroelectric materials are potassium dihydrogen phosphate (KDP), triglycine sulphate (TGS). Examples of high Tc superconductors are YBCO and TBCCO. Examples of dielectric material are sapphire and lanthanum aluminate.

The present invention uses low loss ferroelectrics as discussed by Rytz et al. D Rytz, M. B. Klein, B. Bobbs, M. Matloubian and H. Fetterman, Dielectric Properties of $KTa_{1-x}Nb_xO_3$ at millimeter wavelengths," Japan. J. Appl. Phys. vol. 24 (1985), Supp. 24-2, pp. 1010–1012.

Another objective of this invention is to design CPW structures on a high permittivity ferroelectric material.

Deficiencies of CPW of Jackson and U.S. Pat. No. 5,472,936 are listed in the following table:

| ITEM | JACKSON and 5,472,936 | THIS INVENTION |
|---|---|---|
| | STRUCTURAL | |
| KTN | NO | YES |
| SINGLE CRYSTAL FERROELECTRIC | NO | YES |
| SINGLE CRYSTAL DIELECTRIC | NO | YES |
| SINGLE CRYSTAL HIGH Tc SUPERCONDUCTOR | NO | YES |
| | OPERATING | |
| ABOVE CURIE TEMPERATURE | NO | YES |
| HYSTERESIS | YES | NO |
| LOSS | HIGH | 0.035 dB/WAVELENGTH |

With these and other objectives in view, as well hereinafter be more particularly pointed out in detail in the appended claims, reference is now made to the following description taken in connection with accompanying diagrams.

BRIEF DESCRIPTION OF THE INVENTION

DETAILED DESCRIPTION OF THE PREFERRED EMBODIMENT

Figure 1:
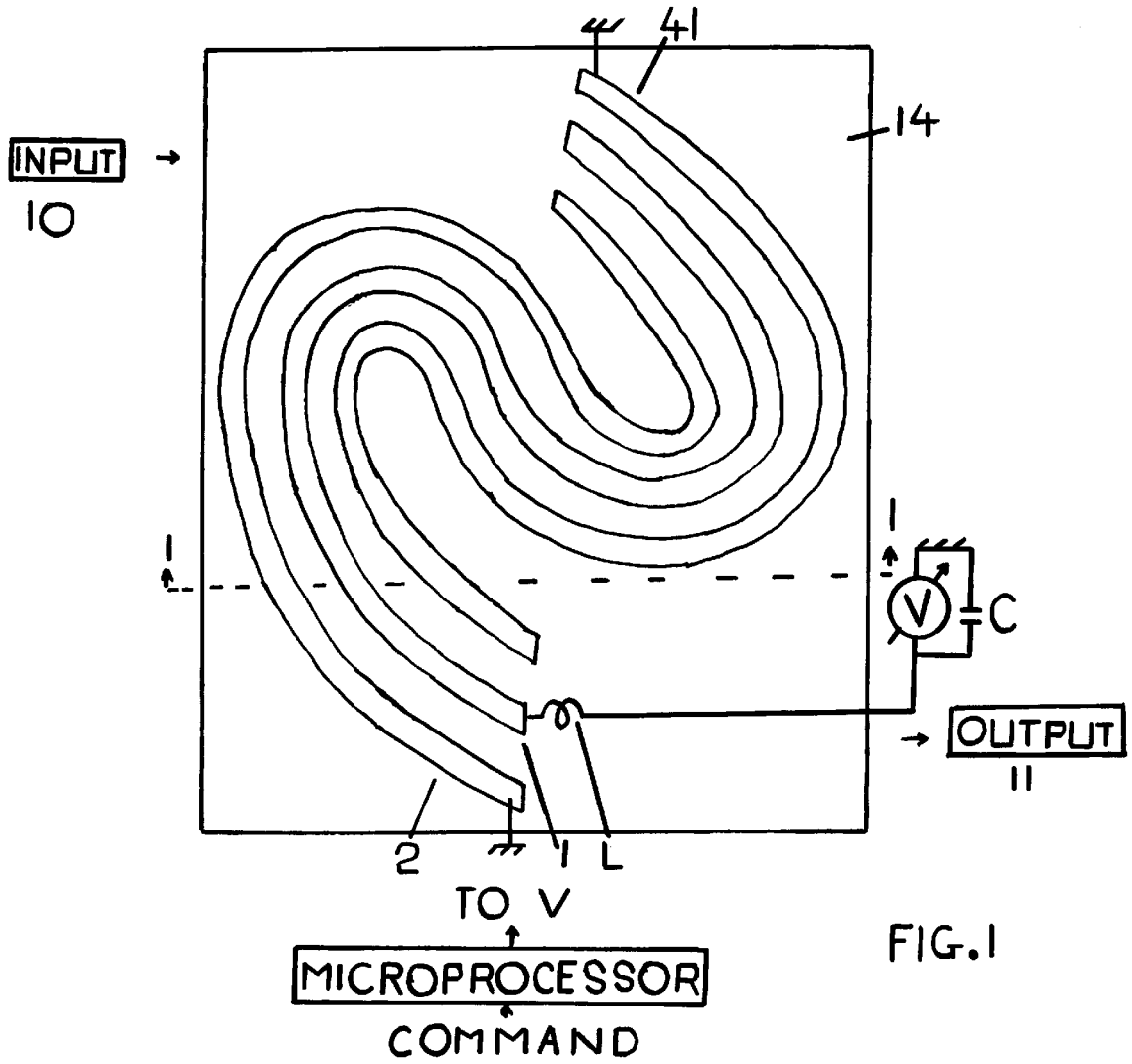
FIG. 1 depicts a top view of an embodiment of this invention.

FIG. 1 depicts an embodiment of this invention, a symmetrical coplanar waveguide (CPW) variable time delay device. A coplanar waveguide is formed by a spiral with three arms. One arm is labeled 1, the second arm is labeled 2 and the 3rd arm is labeled 41. The spiral arms labeled 1 and 2 are separated by equal distance. The spiral arms labeled 1 and 41 are separated by equal distance. The spiral arms labeled 1, 2 and 41 are formed by the deposition of a film of a conductor, a third layer, on a film 14 of a single crystal ferroelectric material, a second layer, which is deposited on a single crystal dielectric material, a first layer not shown in this diagram. Input is 10 and the output is 11. The CPW spirals labeled 1, 2 and 41 form a time delay device. When a bias voltage V is applied between the spiral arms labeled 1 and 2, and 1 and 41 through a bias filter made of an inductor L and a capacitor C, the permittivity of the ferroelectric film between the spiral arms labeled 1 and 2, and 1 and 41, or across the CPW, changes producing a change in the time delay. By the application of different levels of bias voltage between the two spiral arms labeled 1 and 2, and between arms 1 and 41 different permittivity of the ferroelectric material are obtained and thus different changes in the time delay are obtained. Thus a variable time delay is obtained. The variation of time delay as a function of the bias voltage V is stored in a memory of the microprocessor 20. On giving a command for a particular value in the change of the time delay, appropriate bias voltage is applied to the time delay device under the control of the microprocessor 20. In one embodiment, the conductor operates generally at the room temperature.

Examples are copper, silver, gold. In another embodiment, the conductor is a single crystal high Tc superconductor.

The purpose of single crystal materials, in all embodiments of this invention, are discussed here. A single crystal ferroelectric material is used to obtain a dielectric loss, typically, of 0.035 dB per wavelength in the ferroelectric material A single crystal high Tc superconductor is used to obtain a minimum conductive loss. A single crystal dielectric is used to obtain a minimum dielectric loss. A single crystal material is also needed for epitaxial deposition. Examples of a single crystal ferroelectric material are $Sr_{1-x}Ba_xTiO_3$, $Sr_{1-x}Pb_xTiO_3$, $KTa_{1-x}Nb_xO_3$ where the value of x varies between 0.005 and 0.7 Examples of high Tc superconductors are YBCO and TBCCO. Examples of dielectric material are sapphire and lanthanum aluminate. Compositions of polythene and strontium barium titanate or strontium lead titanate are candidate ferroelectric materials. Ferroelectric liquid crystals (FLC) are also candidate ferroelectric materials.

Figure 2:
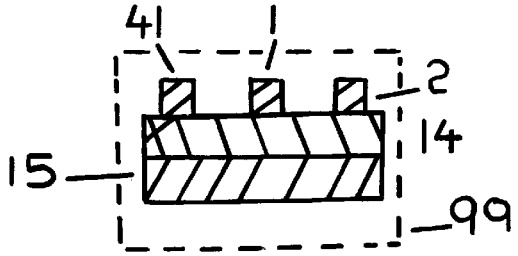
FIG. 2 depicts a longitudinal cross-section of FIG. I through section line AB.

FIG. 2 is a cross-section of FIG. 1 through section line AB. The cross-sections of the spiral arms are labeled 1, 2 and 41. A film of a single crystal ferroelectric material 14 is a second layer. A single crystal dielectric material substrate is 15. The variable time delay is operated at a constant temperature slightly above the Curie temperature of the ferroelectric material. When conductors like copper, silver, gold are used, the time delay device is generally kept at the room temperature. The means for keeping at a constant temperature is 99. When a high Tc superconductor material is used, 99 is a cryocooler to keep the time delay device at a constant high superconducting temperature which is currently between 77 and 105 degrees Kelvin.

Figure 3:
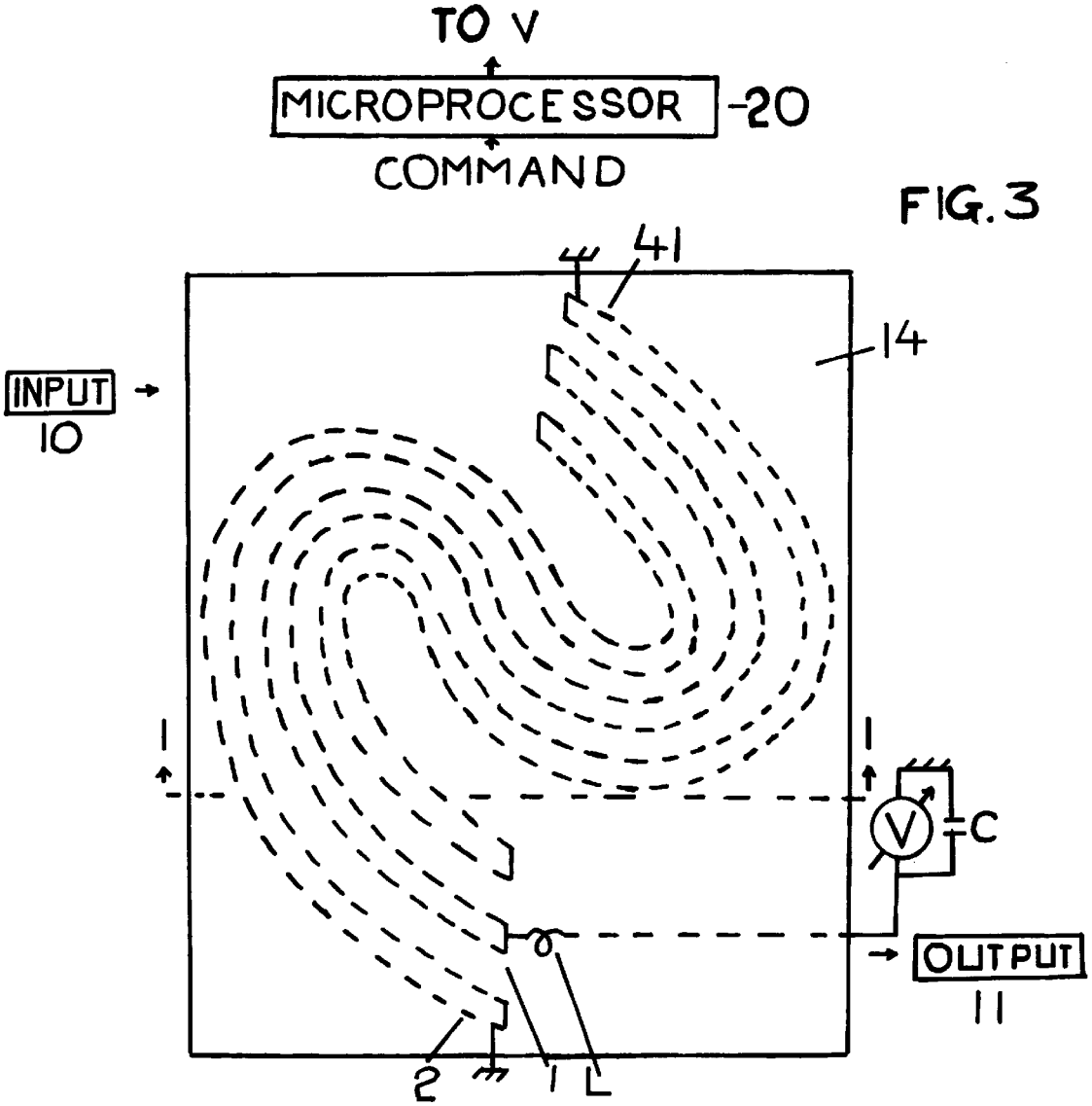
FIG. 3 depicts another embodiment of this invention.
Figure 4:
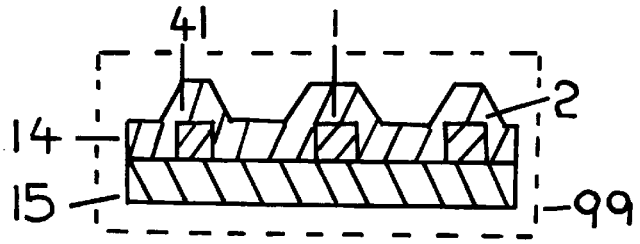
FIG. 4 depicts a longitudinal cross-section of FIG. 1 through section line AB.

A small number of turns of the spiral arms labeled 1 and 2 are shown in FIG. 1. Depending on the requirements, the number of turns of the spiral arms is 1, 2 . . . n. FIG. 3 depicts another embodiment of this invention, a symmetrical CPW variable time delay device. The main difference between FIG. 1 and FIG. 3 is in the contents of the second and third layers. The second layer is a symmetrical CPW time delay circuit. The time delay circuit is formed by the deposition of films of a conducting material on the single crystal dielectric material substrate of a first layer. The third layer is a film of a single crystal ferroelectric material deposited on the single crystal dielectric material of the first layer and also on the CPW time delay circuit shown dotted. CPW spiral arms are labeled 1, 2 and 41. Same number/label refers to the same element throughout this document. The effect of this design is as follows : (1) the CPW time delay circuit is protected, (2) the bias voltage is applied to a larger volume of the single crystal ferroelectric material, and (3) the possibility of unwanted radiation loss is minimized. The rest of the discussions of FIG. 1 are applicable here by reference. FIG. 4 depicts a longitudinal cross-section of FIG. 3 through section line AB. The spiral arms are labeled 1, 2 and 41. The difference between FIG. 2 and FIG. 4 is in the contents of the second and third layers. The spiral arms labeled 1, 2 and 41 are films of a conductor deposited on the single crystal dielectric material 15 of a first layer. A film 14 of a single crystal ferroelectric material is deposited on the single crystal dielectric material 15 of the first layer and on the spiral arms labeled 1, 2 and 41. Same number/label refers to the same element throughout this document. The rest of the discussions of FIG. 2 are applicable here by reference.

Figure 5:
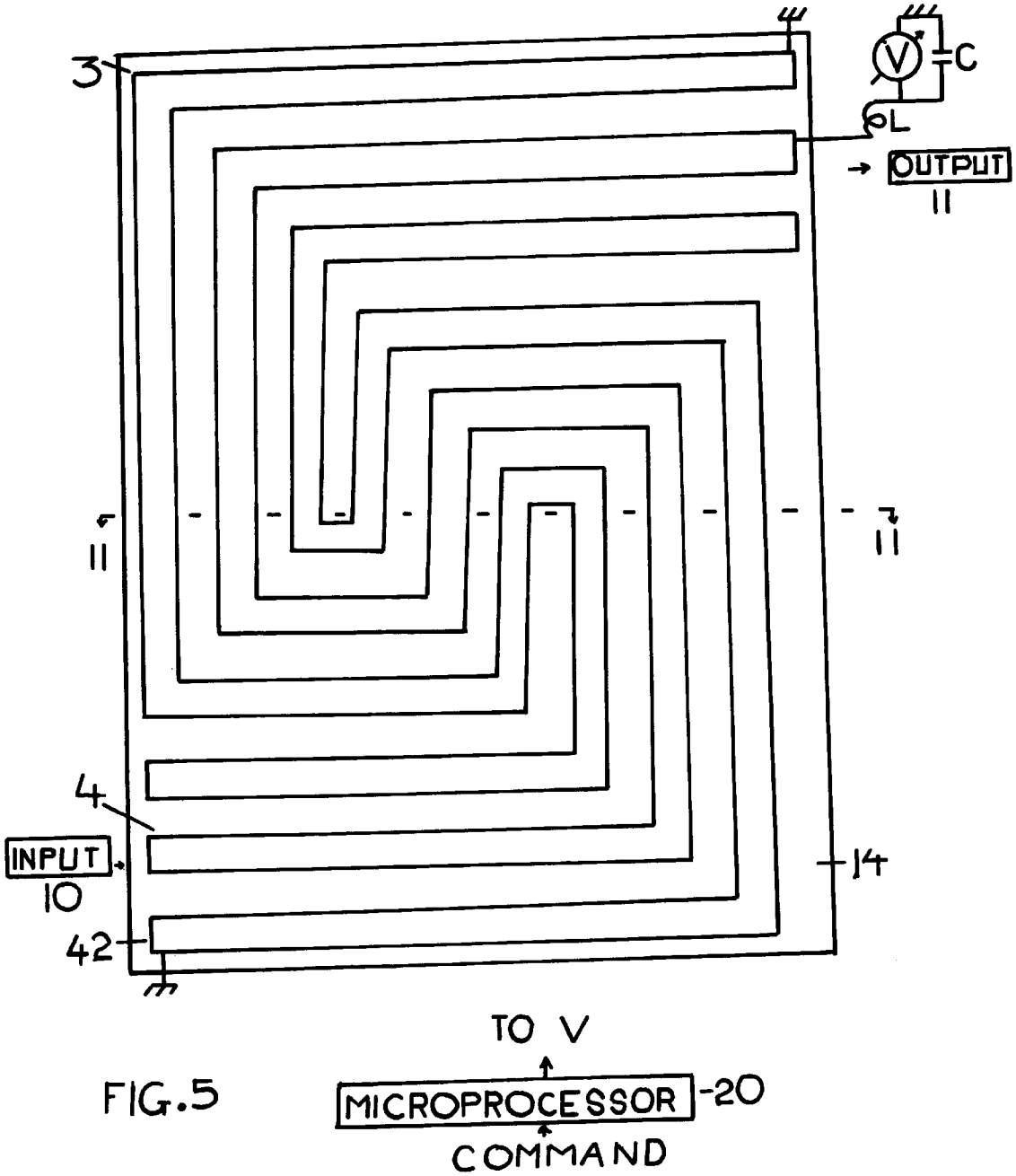
FIG. 5 depicts another embodiment of this invention.
Figure 6:
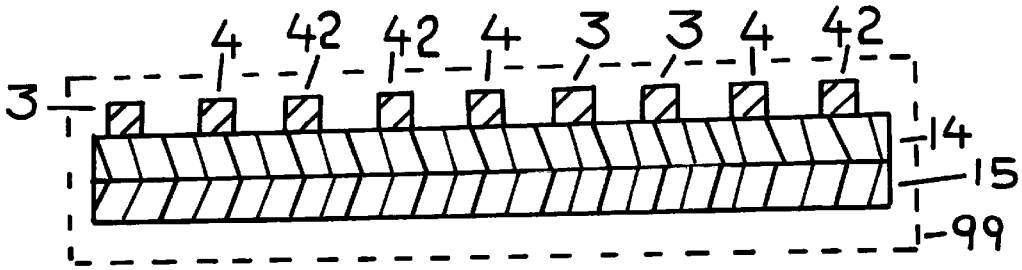
FIG. 6 depicts a longitudinal cross-section of FIG. 5 through section line CD.

FIG. 5 depicts an embodiment of this invention, a symmetrical coplanar waveguide (CPW) variable time delay device. A coplanar waveguide is formed by a square shaped delay device with three arms. One arm is labeled 3, the second arm is labeled 4 and the third arm is labeled 42. The arms labeled 3 and 4 are separated by equal distance. The arms labeled 4 and 42 are separated by equal distance. The square shaped arms labeled 3, 4 and 42 are formed by the deposition of films of a conductor, a third layer, on a film 14 of a single crystal ferroelectric material, a second layer, which is deposited on a first layer of a single crystal dielectric material. Input is 10 and the output is 11. The CPW square arms labeled 3, 4 and 42 form a time delay device. When a bias voltage V is applied between the square shaped arms labeled 3 and 4 and between 4 and 42 through a bias filter made of an inductor L and a capacitor C, the permittivity of the ferroelectric film between the square shaped arms labeled 3 and 4 and between 4 and 42, or across the CPW, changes producing a change in the time delay. By the application of different levels of bias voltage between the spiral arms labeled 3 and 4 and between 4 and 42, different permittivity of the ferroelectric material are obtained and thus different changes in the time delay are obtained. Thus a variable time delay is obtained. The variation of time delay as a function of the bias voltage V is stored in a memory of the microprocessor 20. On giving a command for a particular value in the change of the time delay, appropriate bias voltage is applied to the time delay device under the control of the microprocessor 20. In one embodiment, the conductor operates generally at the room temperature. Examples are copper, silver, gold. In another embodiment, the conductor is a high Tc superconductor. FIG. 6 depicts a longitudinal cross-section of FIG. 5 through section line CD. A single crystal dielectric material 15 is the first layer substrate. A film of a single crystal ferroelectric material 14, of a second layer, is deposited on the first layer. Films of a conductor material are deposited on the film 14 of a single crystal ferroelectric material forming the CPW square time delay device. The cross-sections of the square time delay device are 3, 4, 42, 42, 4, 3, 3,4 and 42. A means for keeping the variable time delay device at a constant temperature is 99. Same number/label refers to the same element throughout this document. The rest of the recitation of FIG. 2 are applicable here by reference.

Figure 7:
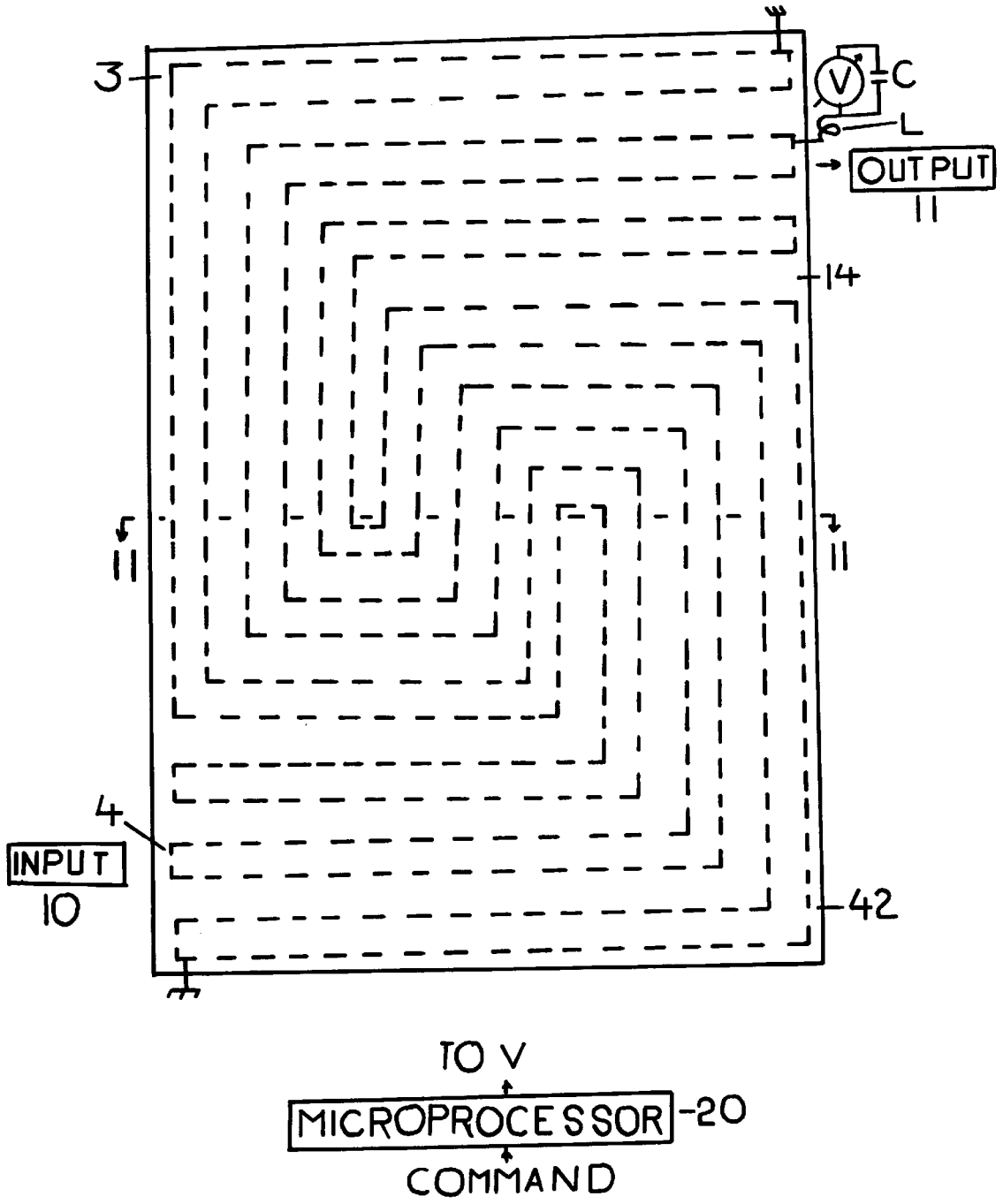
FIG. 7 depicts a top view of another embodiment of this invention.

FIG. 7 depicts another embodiment of this invention, a symmetrical CPW variable time delay device. The basic difference between FIG. 5 and FIG. 7 is in the contents of a second layer and a third layer. In FIG. 7, the films of a conductive material, of the second layer, forming the CPW time delay circuit, are deposited on a single crystal dielectric material not shown in this diagram. A film 14 of a single crystal ferroelectric material, the third layer, is deposited on the single crystal dielectric material and on the deposition of a conductive material of the CPW time delay device. The CPW lines are labeled 3, 4 and 42. Same number/label refers to the same element throughout this document. The rest of the recitations of FIG. 5 are applicable here by reference.

Figure 8:
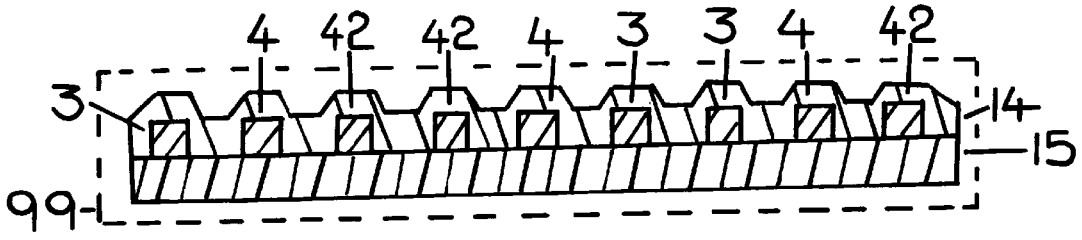
FIG. 8 depicts a longitudinal cross-section of FIG. 7 through section line CD.

FIG. 8 depicts a longitudinal cross-section of FIG. 7 through section line CD. The cross-sections of the CPW square time delay device are 3, 4, 42, 42, 4, 3, 3, 4 and 42. Films of a conductive material forms a second layer. A film 14 of a single crystal ferroelectric material is a third layer. Same number/label refers to the same element throughout the document. The rest of the recitations of FIG. 6 are applicable here by reference.

Figure 9:
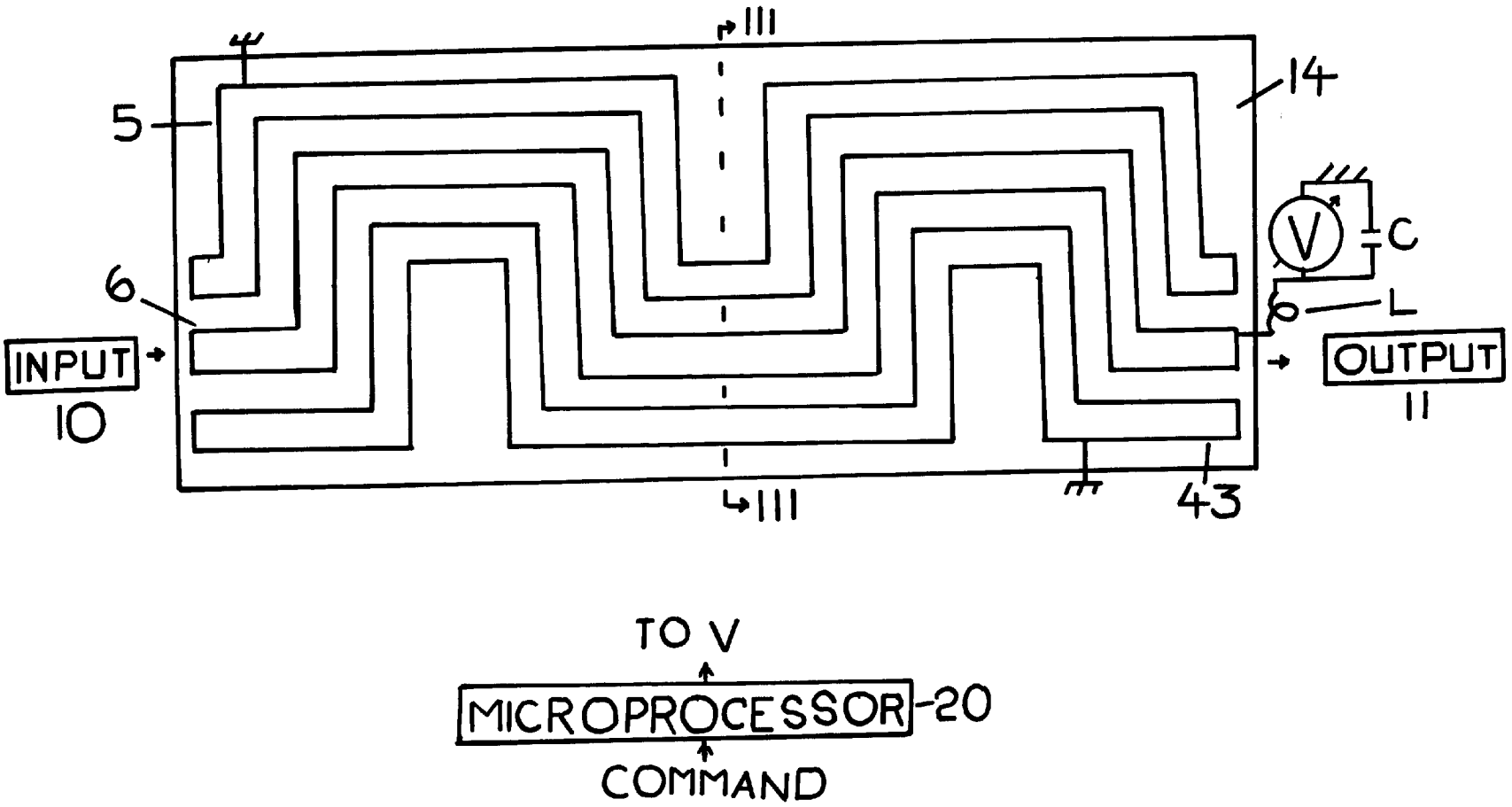
FIG. 9 depicts a top view of another embodiment of this invention.

FIG. 9 depicts an embodiment of this invention, a symmetrical coplanar waveguide (CPW) variable time delay device. A coplanar waveguide is formed by a meander line with three arms. One arm is labeled 5, the second arm is labeled 6 and the 3rd arm is labeled 43. The arms labeled 5 and 6 are separated by equal distance. The arms labeled 6 and 43 are separated by equal distance. The meander line arms labeled 5, 6 and 43 are formed by the deposition of a film of a conductor, a third layer, on a film 14 of a single crystal ferroelectric material, a second layer which is deposited on a first layer of a single crystal dielectric material. Input is 10 and the output is 11. The CPW meander line arms labeled 5, 6 and 43 form a time delay device. When a bias voltage V is applied between the meander line arms labeled 5 and 6, and 6 and 43 through a bias filter made of an inductor L and capacitor C, the permittivity of the ferroelectric film between the meander line arms labeled 5 and 6, and between arms 6 and 43 or across the CPW, changes producing a change in the time delay. By the application of different levels of bias voltage between the meander line arms labeled 5 and 6, and between arms 6 and 43 different permittivity of the ferroelectric material are obtained and thus different changes in the time delay are obtained. Thus a variable time delay is obtained. The variation of time delay as a function of the bias voltage V is stored in a memory of the microprocessor 20. On giving a command for a particular value in the change of the time delay, appropriate bias voltage is applied to the time delay device under the control of the microprocessor 20. In one embodiment, the conductor operates generally at the room temperature. Examples are copper, silver, gold. In another embodiment, the conductor Is a high Tc superconductor. A small number of turns of the meander lines has been shown in FIG. 9. Depending on the requirements, meander lines have 1, 2 . . . n turns.

FIG. 2 also depicts a transverse cross-section of FIG. 9. through section line EF. The numbers 41, 1 and 2 of FIG. 2 represent 43, 6 and 5 respectively of FIG. 9. The cross-sections of the meander line arms are labeled 5, 6 and 43. A film of a single crystal ferroelectric material is 14, a second layer. A single crystal dielectric material substrate is 15. The variable time delay is operated at a constant temperature slightly above the Curie temperature of the ferroelectric material. When conductors like copper, silver, gold are used, the time delay device is generally kept at the room temperature. The means for keeping at a constant temperature is 99. When a high Tc superconductor material is used, 99 is a cryocooler to keep the time delay device at a constant high superconducting temperature which is currently between 77 and 105 degrees Kelvin.

Figure 10:
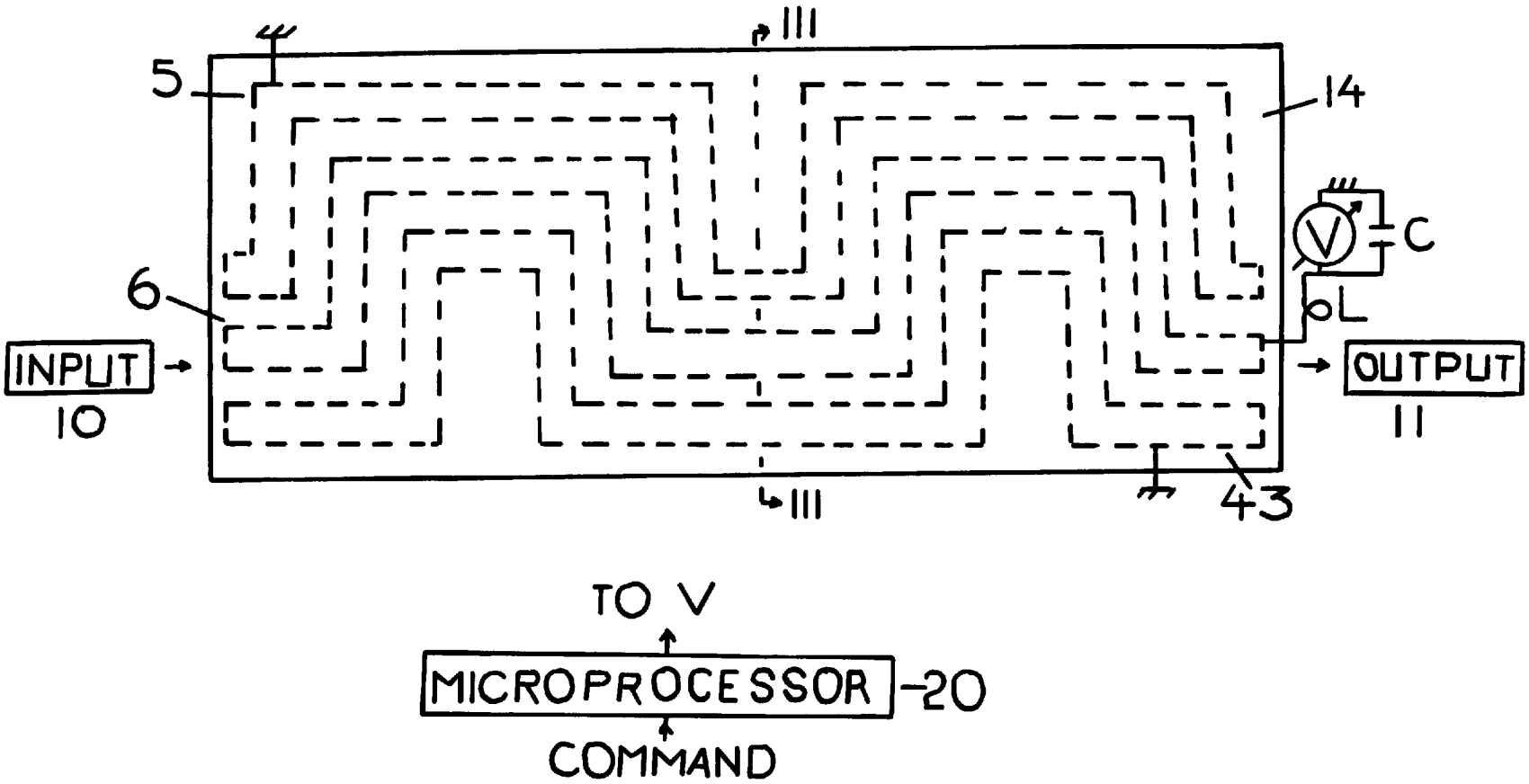
FIG. 10 depicts a top view of another embodiment of this invention.

FIG. 10 depicts another embodiment of this invention, a symmetrical CPW variable time delay device. The difference between FIG. 9 and FIG. 10 is in the contents of a second layer and a third layer. Films labeled 5, 6 and 43 of the second layer, of a conductive material are deposited on a single crystal dielectric material of a first layer. A film 14 of a single crystal ferroelectric material, of the third layer, is deposited on the single crystal dielectric crystal material 15 and on the films labeled 5, 6 and 43 of a conductive material of the second layer. Same number/label refers to the same element throughout this document. The recitations of FIG. 9 are applicable here by reference.

FIG. 4 also represents a transverse cross-section of FIG. 10 through section line EF where numerals 41, 1 and 2 of FIG. 4 represent numerals 43, 6 and 5 of FIG. 10 respectively. FIG. 4 has been recited earlier.

Figure 11:
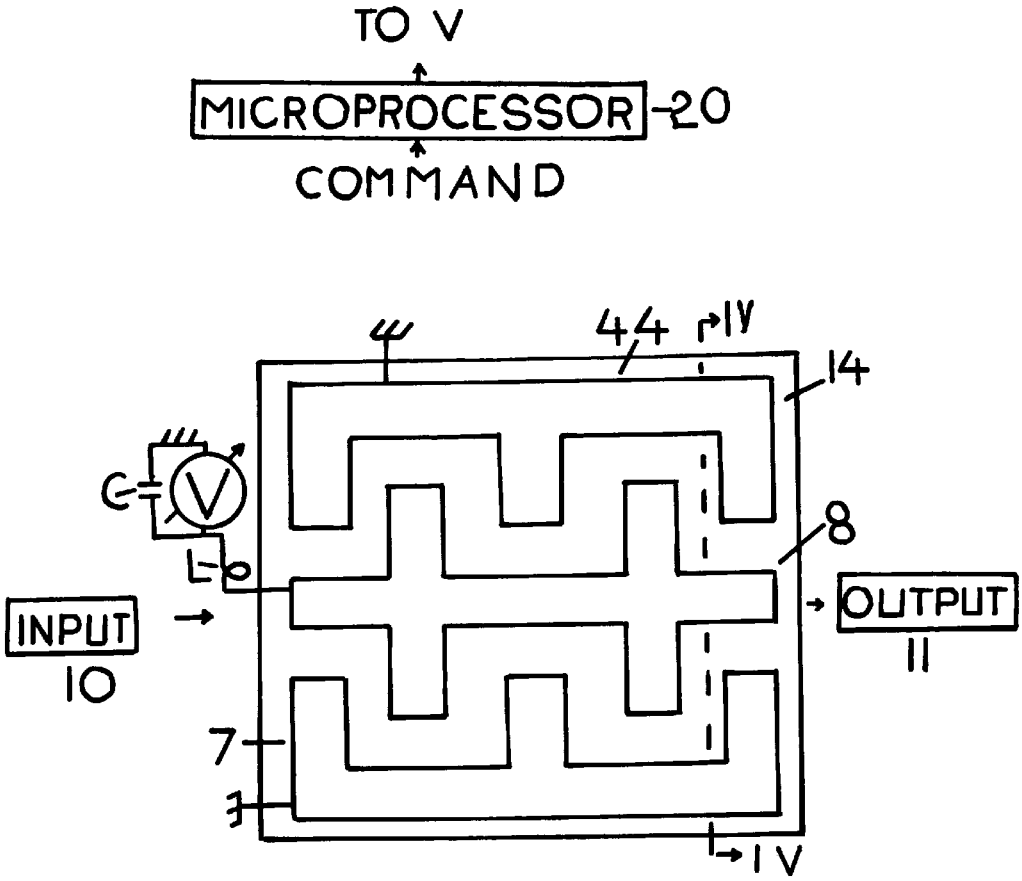
FIG. 11 depicts a top view of another embodiment of this invention.

FIG. 11 depicts an embodiment of this invention, a symmetrical coplanar waveguide (CPW) variable time delay device. A coplanar waveguide is formed by interdigital lines with three arms. One arm is labeled 7, the second arm is labeled 8 and the 3rd arm is labeled 44. The arms labeled 7 and 8 are separated by equal distance. The arms labeled 8 and 44 are separated by equal distance. The interdigital line arms labeled 7, 8 and 44 are formed by the deposition of a film of a conductor, a third layer on a film 14 of a single crystal ferroelectric material, a second layer, which is deposited on a single crystal dielectric material, a first layer. Input is 10 and the output is 11. The CPW interdigital line labeled 7, 8 and 44 form a time delay device. When a bias voltage V is applied between the interdigital line arms labeled 7 and 8, and between 8 and 44 through a bias filter made of an inductor L and a capacitor C, the permittivity of the ferroelectric film between the interdigital line arms labeled 7 and 8, and 8 and 44 or across the CPW, changes producing a change in the time delay. By the application of different levels of bias voltage between the interdigital line arms labeled 7 and 8, and 8 and 44 different permittivity of the ferroelectric material are obtained and thus different changes in the time delay are obtained. Thus a variable time delay is obtained. The variation of time delay as a function of the bias voltage V is stored in a memory of the microprocessor 20. On giving a command for a particular value in the change of the time delay, appropriate bias voltage is applied to the time delay device under the control of the microprocessor 20. In one embodiment, the conductor operates generally at the room temperature. Examples are copper, silver, gold. In another embodiment, the conductor is a high Tc superconductor.

FIG. 2 also represents a transverse cross-section of FIG. 11 through section line EF where 41, 1 and 2 of FIG. 3 represent 7, 8 and 44 of FIG. 11. FIG. 2 has been recited earlier.

A small number of fingers of the interdigital lines has been shown in FIG. 11. Depending on the requirements, interdigital lines have 1, 2 . . . n turns.

Figure 12:
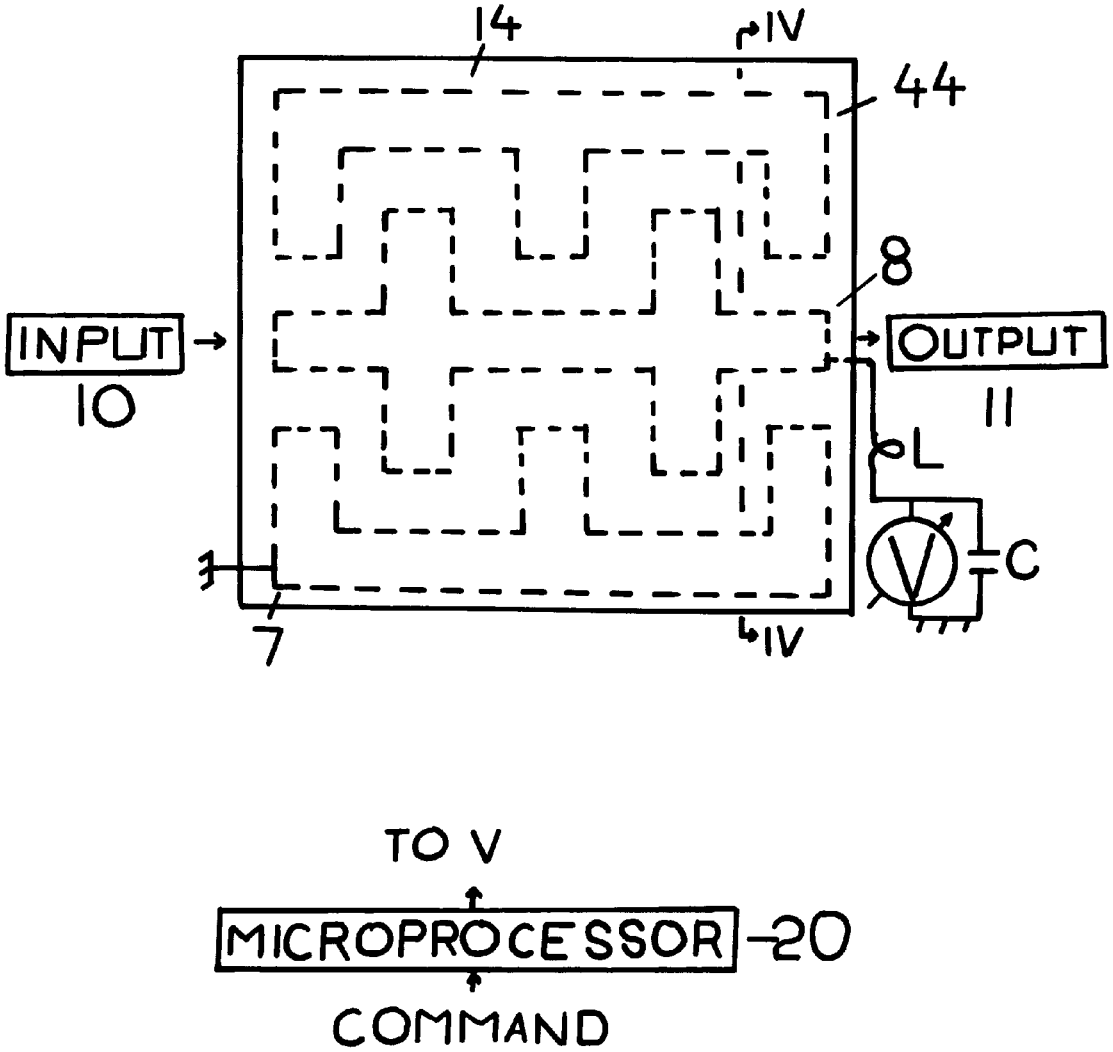
FIG. 12 depicts a top view of another embodiment of this invention.

FIG. 12 depicts another embodiment of this invention, a symmetrical CPW variable time delay device. In FIG. 12, films 7, 8 and 44, of a second layer, of a conductive material are deposited on a single crystal dielectric material, not shown in this diagram, of a first layer. A film 14, of a third layer, of a single crystal ferroelectric material is deposited on the single crystal dielectric material of a first layer and on the conductive depositions 44, 8 and 7 of the second layer. Same number/ label refers to the same element throughout this document. Recitations of FIG. 11 are applicable here by reference.

FIG. 4 also depicts a transverse cross-section of FIG. 12 through section line EF where numerals 41, 1 and 2 of FIG. 4 represent 44, 8 and 7 respectively of FIG. 12. FIG. 4 has been recited earlier.

Figure 13:
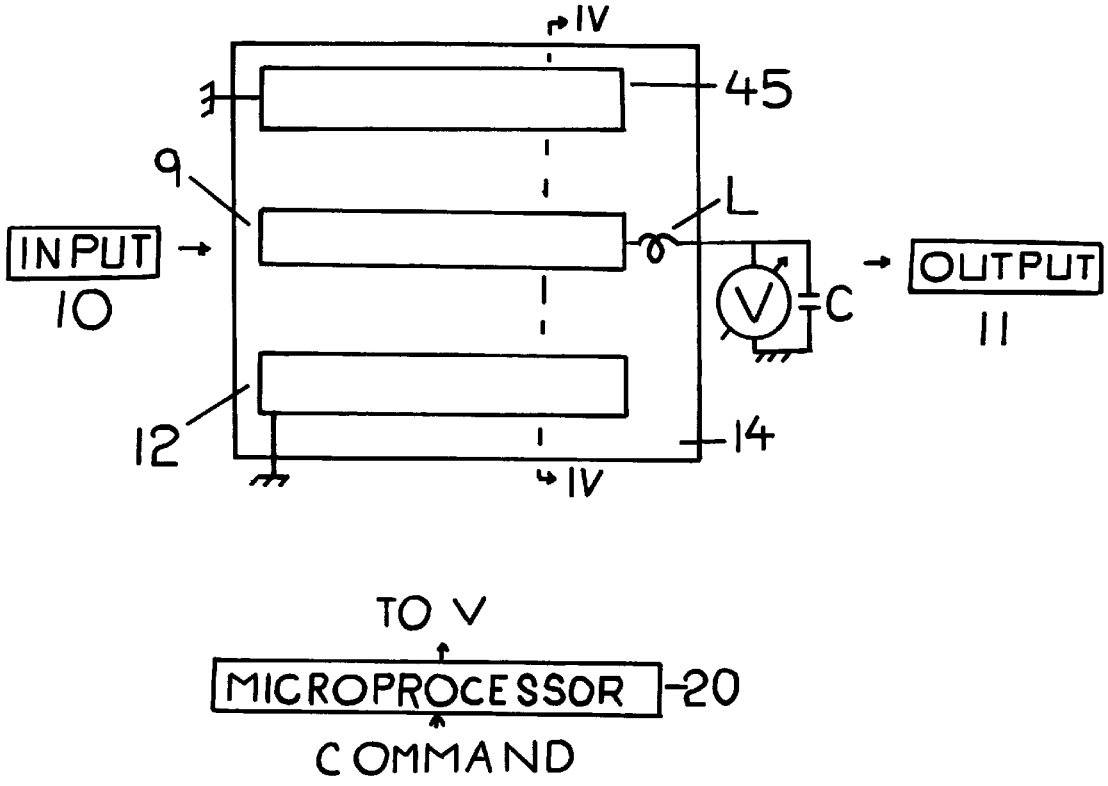
FIG. 13 depicts a top view of another embodiment of this invention.

FIG. 13 depicts an embodiment of this invention, a symmetrical CPW line variable time delay device. A coplanar waveguide is formed by three parallel lines. One line is labeled 9, the second line is labeled 12 and the 3rd line is labeled 45. The lines labeled 9 and 12 are separated by equal distance. The lines labeled 9 and 45 are separated by equal distance. The parallel CPW line labeled 9, 12 and 45 are formed by the deposition of a film of a conductor, a third layer, on a film 14 of a single crystal ferroelectric material, a second layer, which is deposited on a single crystal dielectric material, a first layer. Input is 10 and the output is 11. The three parallel CPW lines labeled 9, 12 and 45 form a time delay device. When a bias voltage V is applied between the parallel lines labeled 9 and 12, and 9 and 45 through a bias filter made of an inductor L and a capacitor C, the permittivity of the ferroelectric film between the lines labeled 9 and 12, and between 9 and 45 or across the CPW, changes producing a change in the time delay. By the application of different levels of bias voltage between the CPW lines labeled 9 and 12, and between 9 and 45 different permittivity of the ferroelectric material are obtained and thus different changes in the time delay are obtained. Thus a variable time delay is obtained. The variation of time delay as a function of the bias voltage V is stored in a memory of the microprocessor 20. On giving a command for a particular value in the change of the time delay, appropriate bias voltage is applied to the time delay device under the control of the microprocessor 20. In one embodiment, the conductor operates generally at the room temperature. Examples are copper, silver, gold. In another embodiment, the conductor is a high Tc superconductor.

FIG. 2 also represents a transverse cross-section of FIG. 13 through section line EF where 41, 1 and 2 of FIG. 2 represent 45, 9 and 12 of FIG. 13 respectively. FIG. 2 has been recited earlier.

Figure 14:
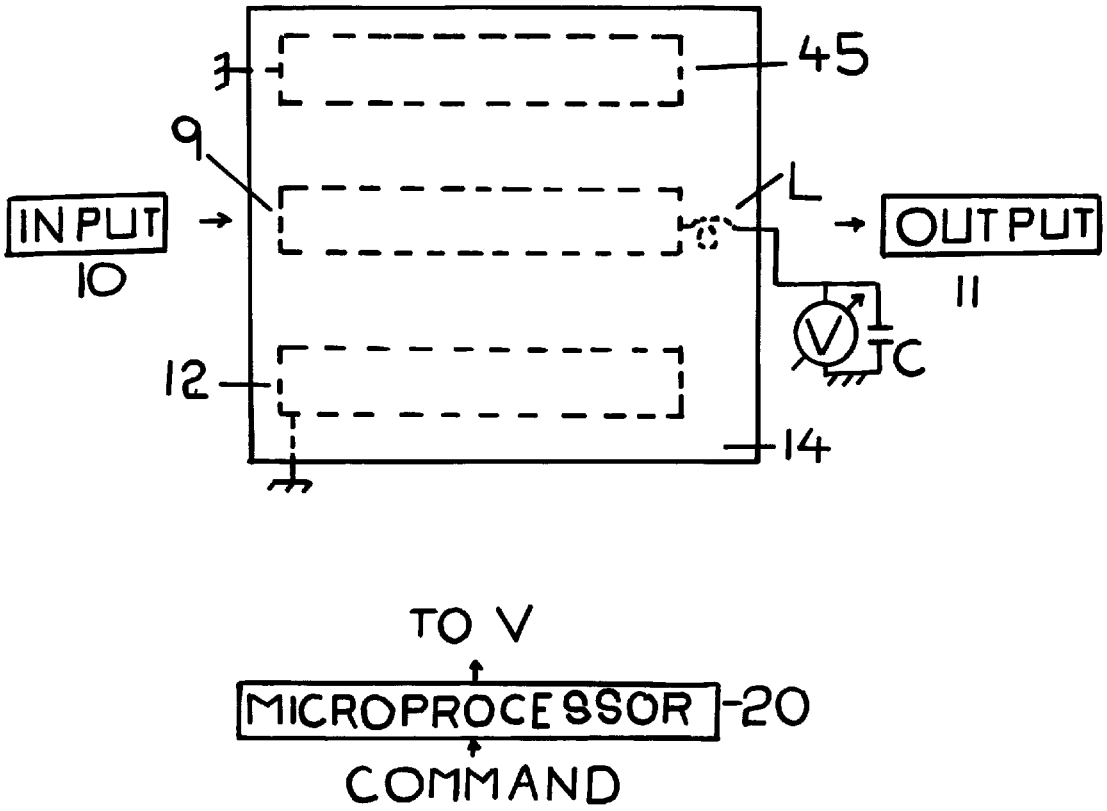
FIG. 14 depicts a top view of another embodiment of this invention.

FIG. 14 depicts another embodiment of this invention, a symmetrical CPW variable time delay device. In FIG. 14 films 12, 9 and 45, of a second layer, of a conductive material are deposited on a single crystal dielectric material, not shown in this diagram, of a first layer. A film 14, of a third layer, of a single crystal ferroelectric material Is deposited on the single crystal dielectric material of the first layer and on the conductive depositions 45, 9 and 12 of the second layer. Same number/label refers to the same element throughout this document. Recitations of FIG. 13 are applicable here by reference.

FIG. 4 also depicts a transverse cross-section of FIG. 14 through section line EF where numerals 41, 1 and 2 of FIG. 4 represent 45, 9 and 12 respectively of FIG. 14. FIG. 4 has been recited earlier.

Figure 15:
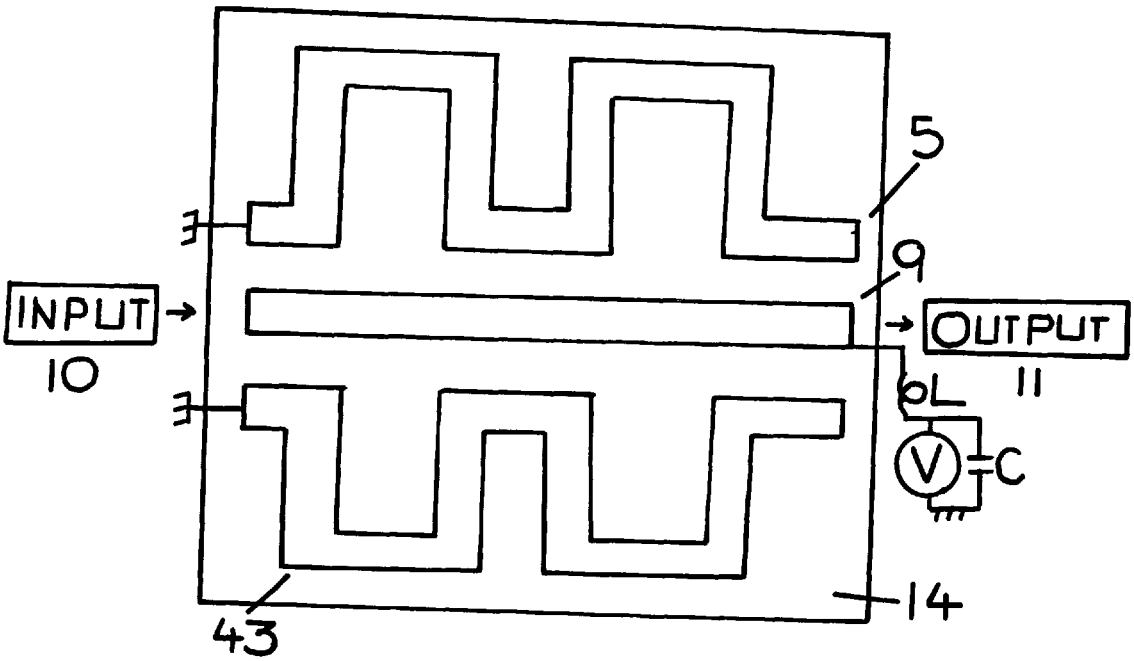
FIG. 15 depicts a top view of another embodiment of this invention.
Figure 15:
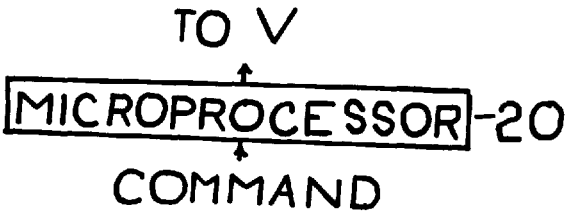

FIG. 15 depicts another embodiment of this invention, a symmetrical CPW meander line variable time delay device. The center CPW structure labeled 9 is a straight line. On one side of 9 is a meander line labeled 5. On the other side of 9 is a meander line labeled 443. Same number/label refers to the same element throughout this document. By reference, applicable recitations of FIG. 9 are introduced here. FIG. 2 also depicts a transverse cross-section of FIG. 15 through section line EF where 41, 1 and 2 of FIG. 2 respectively represent 43, 9 and 5 of FIG. 15. FIG. 2 has been recited earlier.

Figure 16:
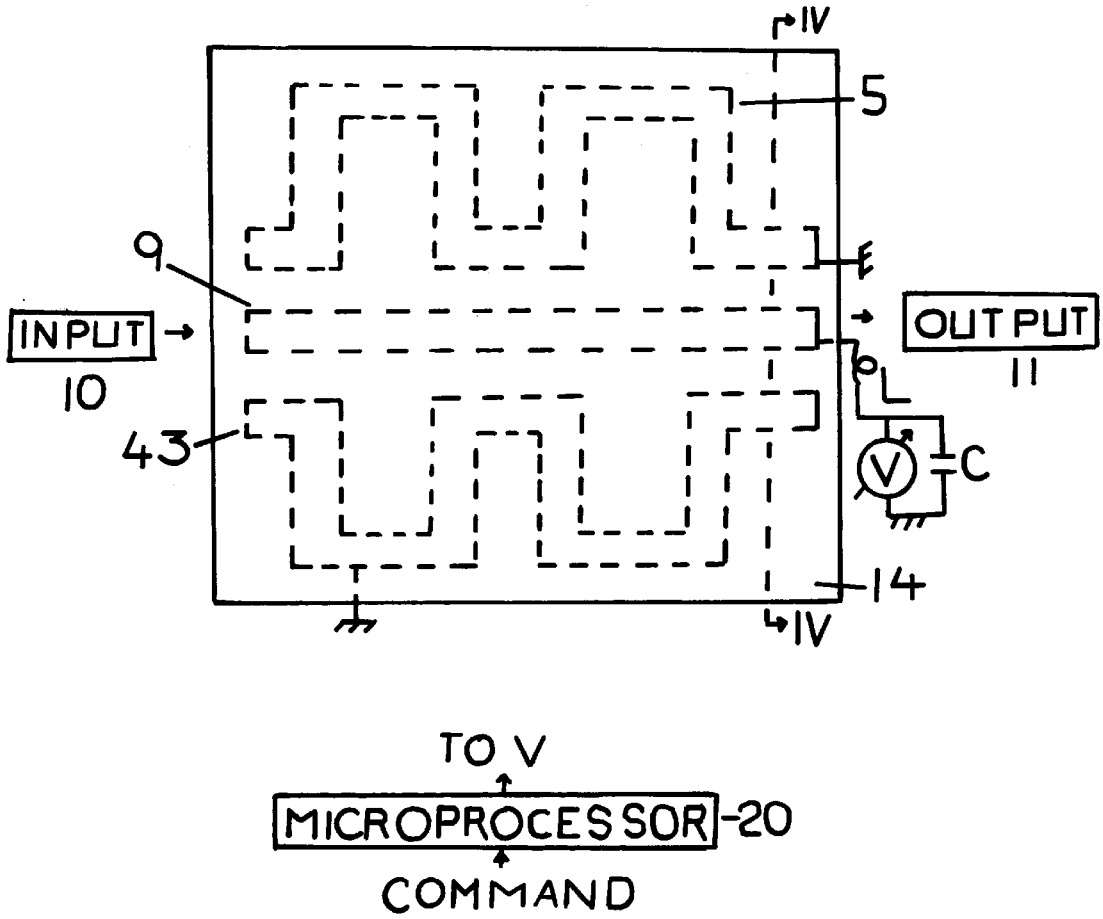
FIG. 16 depicts a top view of another embodiment of this invention.

FIG. 16 depicts another embodiment of this invention, a symmetrical CPW meander line variable time delay device. The difference between FIG. 15 and FIG. 16 is in the contents of a second layer and a third layer. In FIG. 16, films labeled 43, 9 and 5 are depositions, on a single crystal dielectric material of a first layer, of a conductive material forming a second layer. Film labeled 14 of a single crystal ferroelectric material, of a third layer, is deposited on the single crystal dielectric material of a first layer and on conductive depositions labeled 43, 9 and 5 of the second layer. Same number/label refers to the same element throughout this document. Portions of FIGS. 9 and 10 are applicable here by reference.

FIG. 4 also depicts a transverse cross-section of FIG. 16 through section line EF where 41, 1 and 2 of FIG. 4 respectively represent 43, 9 and 5 of FIG. 16. FIG. 4 has been recited earlier.

Each embodiment of the time delay device has 1, 2 . . . n turns. Other embodiments have polycrystalline ferroelectric materials. Other embodiments have conductive materials which can, generally, work at room temperatures. Examples are copper, silver, gold. Other embodiments have a single crystal high Tc superconductor material.

The following recitations are applicable to all embodiments of this invention. A single crystalline form, as opposed to a multicrystalline form, of a dielectric material is used to obtain a minimum of dielectric loss. A single crystalline, as opposed to a multicrystalline form of a ferroelectric material is used to obtain a dielectric loss of 0.035 dB per wavelength at a high superconducting temperature. A single crystalline, as opposed to a multicrystalline, form of a high Tc superconductor is used to obtain a minimum of conductive loss.

It should be understood that the foregoing disclosure relates to only typical embodiments of the invention and that numerous modification or alternatives may be made therein by those of ordinary skill in art without departing from the spirit and the scope of the invention as set forth in the appended claims.

Specifically, the invention contemplates various dielectrics including sapphire, lanthanum aluminate, different ferroelectric materials, ferroelectric liquid crystals (FLCs), high Tc superconducting materials including YBCO, TBCCO, impedances, MMICs, layers of time delay devices, operating bias voltage of the time delay devices, number of delay sections, and frequencies.

What is claimed is:

1. A ferroelectric variable time delay device having a single crystal ferroelectric material having an electric field dependent permittivity, a Curie temperature, a single crystal high Tc superconductor, and comprising:

first, second, third layers;

said first layer comprised of a single crystal dielectric substrate of a single crystalline form;

said single crystalline form of a single crystal dielectric material provides a minimum dielectric loss;

said second layer comprised of a film of a single crystalline form of said single crystal ferroelectric material being KTN, having said permittivity, deposited on said single crystal dielectric material of first layer;

said single crystalline form of a ferroelectric material provides a dielectric loss, typically, of 0.035 dB per wavelength in the ferroelectric material;

said third layer comprised of a film of a single crystalline form of said single crystal high Tc superconductor material deposited on said film of said single crystal ferroelectric material of second layer;

said single crystalline form of said high Tc superconductor material provides a minimum conductive loss;

said third layer being a spiral shaped symmetrical coplanar waveguide having arms, on both sides of a center arm;

separation distances between said arm in the center and said arms on both sides of said center arm of said spiral being constant;

said three arm spiral coplanar waveguide having 1, 2 . . . n turns;

means for applying a bias voltage to said time delay device;

a microprocessor for controlling said bias voltage, for a specific value of time delay, on command; and means attached to said time delay device, for operating the time delay device at a high superconducting temperature slightly above said Curie temperature of said ferroelectric material to avoid hysteresis.

2. A ferroelectric variable time delay device of claim 1;

wherein said single crystal high Tc superconductor material being YBCO.

3. A ferroelectric variable time delay device of claim 2;

wherein said single crystal dielectric material being sapphire.

4. A ferroelectric variable time delay device of claim 1;

wherein said single crystal high Tc superconductor being TBCCO.

5. A ferroelectric broadband variable time delay device having a single crystal ferroelectric material having an electric field dependent permittivity, a Curie temperature, a single crystal high Tc superconductor, and comprising:

first, second, third layers;

said first layer comprised of a single crystal dielectric substrate of a single crystalline form;

said single crystalline form of a single crystal dielectric material provides a minimum dielectric loss;

said second layer comprised of a film of a single crystalline form of said single crystal high Tc superconductor material deposited on said single crystal dielectric material of said first layer;

said single crystalline form of a high Tc superconductor material provides a minimum conductive loss;

said third layer comprised of a film of a single crystalline form of said single crystal ferroelectric material being KTN, having said permittivity, deposited on said single crystal dielectric material of said first layer and on said single crystal high Tc superconductor material of said second layer;

said single crystalline form of a ferroelectric material provides a dielectric loss, typically, of 0.035 dB per wavelength in the ferroelectric material;

said second layer being a meander line shaped symmetrical coplanar waveguide having arms on both sides of a center arm;

separation distances between said arm in the center and said arms on both sides of said center arm of said meander line being constant;

said three arm meander line coplanar waveguide having 1, 2 . . . n turns;

means for applying a bias voltage to said time delay device;

a microprocessor for controlling said bias voltage, for a specific value of time delay, on command; and means attached to said time delay device, for operating the time delay device at a high superconducting temperature slightly above said Curie temperature of said ferroelectric material to avoid hysteresis.

6. A ferroelectric variable time delay device of claim 5;

wherein said single crystal high Tc superconductor material being YBCO.

7. A ferroelectric variable time delay device of claim 6;

wherein said single crystal dielectric material being sapphire.

8. A ferroelectric variable time delay device of claim 5;

wherein said single crystal high Tc superconductor material being TBCCO.

9. A ferroelectric variable time delay device having a single crystal ferroelectric material having an electric field dependent permittivity, a Curie temperature, a single crystal high Tc superconductor, and comprising:

first, second, third layers;

said first layer comprised of a single crystal dielectric substrate of a single crystalline form;

said single crystalline form of a single crystal dielectric material provides a minimum dielectric loss;

said second layer comprised of a film of a single crystalline form of said single crystal high Tc superconductor material deposited on said single crystal dielectric material of said first layer;

said single crystalline form of a high Tc superconductor material provides a minimum conductive loss;

said third layer comprised of a film of a single crystalline form of said single crystal ferroelectric material being KTN, having said permittivity, deposited on said single crystal dielectric material of said first layer and on said single crystal high Tc superconductor material of said second layer;

said single crystalline form of a ferroelectric material provides a dielectric loss, typically, of 0.035 dB per wavelength in the ferroelectric material;

said second layer being a interdigital shaped symmetrical coplanar waveguide having arms on both sides of a center arm;

separation distances between said arm in the center and said arms on both sides of said center arm of said interdigital circuit being constant;

said three arm interdigital coplanar waveguide having 1, 2 . . . n fingers;

means for applying a bias voltage to said time delay device;

a microprocessor for controlling said bias voltage, for a specific value of time delay, on command; and means attached to said time delay device, for operating the time delay device at a high superconducting temperature slightly above said Curie temperature of said ferroelectric material to avoid hysteresis.

10. A ferroelectric variable time delay device of claim 9;

wherein said single crystal high Tc superconductor material being YBCO.

11. A ferroelectric variable time delay device of claim 10;

wherein said single crystal dielectric material being sapphire.

12. A ferroelectric variable time delay device of claim 10;

wherein said single crystal dielectric material being lanthanum aluminate.

13. A ferroelectric variable time delay device of claim 9;

wherein said single crystal high Tc superconductor material being TBCCO.

14. A ferroelectric variable time delay device of claim 9;

wherein said single crystal dielectric material being lanthanum aluminate;

said single crystal high Tc superconductor material being YBCO.

15. A ferroelectric variable time delay device of claim 9;

wherein said single crystal dielectric material being sapphire;

said single crystal high Tc superconductor material being TBCCO.

16. A ferroelectric variable time delay device of claim 9;

wherein said single crystal dielectric material being sapphire;

said single crystal high Tc superconductor material being TBCCO.

17. A ferroelectric variable time delay device of claim 9;

wherein said single crystal dielectric material being lanthanum aluminate;

said single crystal high Tc superconductor material being TBCCO.

18. A ferroelectric variable time delay device of claim 9;

wherein said single crystal dielectric material being sapphire.

* * * * *